US005553781A

United States Patent [19]

Barkhimer et al.

[11] Patent Number: 5,553,781

[45] Date of Patent: Sep. 10, 1996

[54] CONVERSION OF JERK TYPE INJECTOR TO ACCUMULATOR TYPE INJECTOR

[75] Inventors: Robert L. Barkhimer, Poway; Niels J. Beck, Bonita, both of Calif.

[73] Assignee: Servojet Products International, San Diego, Calif.

[21] Appl. No.: 367,599

[22] Filed: Jan. 3, 1995

[51] Int. Cl.[6] ..... F02M 47/00

[52] U.S. Cl. ..... 239/88; 239/533.8; 239/600

[58] Field of Search ..... 239/88, 1, 96, 239/89, 533.8, 600

[56] References Cited

U.S. PATENT DOCUMENTS

| | | | |
|---|---|---|---|
| Re. 33,270 | 7/1990 | Beck et al. | 123/447 |
| 2,420,550 | 5/1947 | Miller | 239/533.8 X |
| 2,985,378 | 5/1961 | Falberg | 239/96 |
| 3,115,304 | 12/1963 | Humphries | 239/533.8 X |
| 3,610,529 | 10/1971 | Huber | 239/533.8 X |
| 4,228,960 | 10/1980 | Mowbray | 239/533.9 |
| 4,461,427 | 7/1984 | Kopse et al. | 239/533.9 X |
| 4,572,433 | 2/1986 | Deckard | 239/96 X |
| 4,605,166 | 8/1986 | Kelly | 239/96 |
| 4,628,881 | 12/1986 | Beck et al. | 123/447 |
| 4,674,688 | 6/1987 | Kanesaka | 239/533.8 |
| 5,241,935 | 9/1993 | Beck et al. | 123/300 |
| 5,287,838 | 2/1994 | Wells | 123/467 |

FOREIGN PATENT DOCUMENTS

| | | | |
|---|---|---|---|
| 572134 | 12/1993 | European Pat. Off. | 239/533 D |
| 2083861 | 3/1982 | United Kingdom | 239/533 D |

*Primary Examiner*—Kevin P. Weldon
*Attorney, Agent, or Firm*—Nilles & Nilles, S.C.

[57] ABSTRACT

A standard jerk type fuel injector can be converted to an accumulator type fuel injector by modifying internal flow configurations of the injector from ones which lead to injection whenever fluid pressure in a fuel supply passage thereof exceeds a first designated level to ones which present an accumulator and a control cavity and which lead (1) to injector charging when the fluid pressure in the supply passage exceeds a second designated level and (2) to initiation of injection only upon subsequent pressure decay in the supply passage below a third designated level. The conversion can advantageously be performed by replacing a first spacer having a first set of flow configurations with a second spacer having a second set of flow configurations including a non-return element. The resulting injector has (1) an accumulator volume located fluidically downstream of the non-return element and (2) a control cavity above the nozzle needle. The accumulator type injector can be retrofitted into an existing injection system on site or assembled as a new construction by using primarily stock jerk type injector components. Manufacturing expenses can thus be sharply reduced, thereby promoting retrofitting, low volume production, and/or standardization.

16 Claims, 4 Drawing Sheets

CONVERSION OF JERK TYPE INJECTOR TO ACCUMULATOR TYPE INJECTOR

BACKGROUND OF THE INVENTION

1. Field of the Invention

The invention relates to fuel injectors and, more particularly, relates to a method of converting jerk type injectors to accumulator type injectors and to accumulator type injectors thus tomed.

2. Discussion of the Related Art

Jerk type fuel injectors are well known and, indeed, have been the standard in the industry for years. Jerk type injectors are non-accumulator type fuel injectors characterized by their connection to a cyclically activated pump and by the fact that injection begins with the supply of fuel to the injector above a designated pressure level (usually determined by an injector needle return spring) and terminates when fuel pressure as supplied by the pump drops below the designated level. Examples of such injectors are distributed commercially by NAVISTAR under the Part No. 1817126C91 and Standyne under the Part No. 780321.

Accumulator type fuel injectors, although, available for some time, have gained increased acceptance in recent years because they permit more precise control of fuel injection timing and quantity and generate a more efficient falling rate fuel spray than is possible with jerk type injectors and thus can significantly reduce exhaust emissions and provide improved fuel economy. Accumulator type fuel injectors are typically characterized by the use of (1) an accumulator in fluid communication with the nozzle and (2) a control cavity which is located above the upper end of the needle and the pressurization and depressurization of which are electronically controlled by a solenoid valve. Injection begins, after charging of the accumulator by a pump or by a common rail supply source, by venting the control cavity through suitable actuation of the associated solenoid valve. Fuel injection terminates when lifting forces imposed by the pressure in the nozzle cavity and accumulator drops below closing forces imposed by a needle return spring and by the then-diminished fluid pressure in the control cavity. Injection systems employing accumulator type fuel injectors are disclosed, e.g., in U.S. Pat. No. RE 33,270 and U.S. Pat. No. 5,241,935 to Beck et al.

One limitation of currently available accumulator type fuel injectors is that they are structurally significantly and in some instances fundamentally different from the more standard jerk type injectors. Jerk type injector manufacturers are thus reluctant to retool for accumulator type injector manufacturing, particularly for small production volumes. Moreover, conversion of existing jerk type injection systems to accumulator type injection systems currently requires the complete replacement of each of the jerk type injector units with an accumulator type injector unit. Such replacement renders conversion costs prohibitive in many instances.

OBJECTS AND SUMMARY OF THE INVENTION

It is therefore an object of the invention to relatively quickly and easily convert a jerk type fuel injector into an accumulator type fuel injector either by converting an assembled injector or by assembling a new injector using primarily stock jerk type injector components.

Another object of the invention is to retrofit an existing fuel injection system with an accumulator type injection system which includes converting the standard jerk type injectors of the system to accumulator type injectors without replacing the entire injector units.

In accordance with a first aspect of the invention, these objects are achieved by modifying internal flow configurations of a jerk type injector from ones which lead to injection whenever fluid pressure in a supply passage thereof exceeds a first designated level to ones which present an accumulator chamber and a control cavity and which lead (1) to injector charging when the fluid pressure in the supply passage exceeds a second designated level and (2) to initiation of injection only upon subsequent pressure decay in the control cavity below a third designated level. When performed as a retrofit operation, this modification typically comprises replacing a first spacer having a first set of flow configurations with a second spacer having a second set of flow configurations.

Preferably, the modification begins with providing an injector body, a nozzle body, and a nozzle needle. The injector body has a passage formed therethrough for the flow of pressurized fuel. The nozzle body has (1) a central axial bore formed therein and presenting a lower nozzle cavity, and (2) a passage formed therethrough permitting fluid flow between the injector body passage and the nozzle cavity. The nozzle needle is slidably disposed in the axial bore and presents a lower needle valve and an upper axial surface around which is disposed an upper cavity, the upper cavity being sealed from the nozzle cavity. Next, a spacer is inserted between the nozzle body and the injector body. The spacer has a first passage connecting the nozzle body passage to the injector body passage, a second passage connecting the injector body passage to the upper cavity and permitting two-way fluid flow therethrough, and a non-return element which is disposed in the first passage and which at least substantially prevents return fluid flow therethrough. Finally, the injector body, the nozzle body, and the spacer are fixed position.

If constructed by a retrofitting operation, the injector as described above must be partially disassembled by removing a first spacer disposed between the injector body and the nozzle body, the first spacer having a passage formed therethrough which connects the injector body passage and the nozzle body passage and which permits two-way fluid flow therethrough.

If additional accumulator volume is required, the modification additionally comprises providing an injector body having a spring chamber formed therein in which is disposed a needle return spring. The inserting step in this case comprises inserting a spacer having an axial bore formed therethrough in alignment with the spring chamber and a third passage presenting an upper orifice opening into the spring chamber. Additional steps include inserting a pin in the bore so as (1) to be sealingly and slidably disposed in the bore, (2) to extend through the bore and into the spring chamber, and (3) to engage the nozzle needle and the return spring; and forming a second passage in the nozzle body permitting fluid communication between the second nozzle body passage and the third passage in the spacer.

Another object of the invention is to provide an accumulator type injector which can be manufactured with only minor modifications to an existing jerk type injector design.

In accordance with another aspect of the invention, this object is achieved by providing an accumulator type fuel injector comprising an injector body, a nozzle body, a nozzle needle, and a spacer. The injector body has a passage formed therethrough for the passage of pressurized fuel. The nozzle body has formed therein (a) a central axial bore presenting a lower nozzle cavity and an upper cavity which is sealed from the nozzle cavity, and (b) a passage in fluid communication with the nozzle cavity. The nozzle needle is disposed in the axial bore and presents a lower needle valve and an upper axial end around which is disposed the upper cavity. The spacer which is disposed between the injector body and the nozzle body and has (1) a first passage formed therein and connecting the nozzle body passage to the injector body passage, (2) a second passage formed therein, connecting the injector body passage to the upper cavity, and permitting two-way fluid flow therethrough, and (3) a non-return element which is disposed in the first passage and which at least substantially prevents return fluid flow therethrough.

Preferably, in order to increase accumulator volume, a spring chamber is formed in the injector body, another passage is formed in the nozzle body in two-way fluid communication with the nozzle body passage, a third passage is formed in the spacer and connects the spring chamber to the another nozzle body passage, and an axial bore is formed through the spacer in alignment with the spring chamber. A pin sealingly extends through the bore, engages an axial end surface of the nozzle needle, and extends into the spring chamber.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof and the invention includes all such modifications.

BRIEF DESCRIPTION OF THE DRAWINGS

Preferred exemplary embodiments are illustrated in the accompanying drawings in which like numerals represent like pans throughout, and in which.

DETAILED DESCRIPTION OF THE PREFERRED EMBODIMENTS

1. Resume

Pursuant to the invention, a standard jerk type fuel injector can be converted to an accumulator type fuel injector by modifying internal flow configurations of the injector from ones which lead to injection whenever fluid pressure in a fuel supply passage thereof exceeds a first designated level to ones which present an accumulator and a control cavity and which lead (1) to injector charging when the fluid pressure in the supply passage exceeds a second designated level and (2) to initiation of injection only upon subsequent pressure decay in the supply passage below a third designated level. The conversion can advantageously be performed by replacing a first spacer having a first set of flow configurations with a second spacer having a second set of flow configurations including a non-return element. The resulting injector has (1) an accumulator volume located fluidically downstream of the non-return element and (2) a control cavity above the nozzle needle. The accumulator type injector can be retrofitted into an existing injection system on site or assembled as a new construction by using primarily stock jerk type injector components. Manufacturing expenses can thus be sharply reduced, thereby promoting retrofitting, low volume production, and/or standardization.

2. Construction and Operation of Jerk Type Injector

Figure 1:
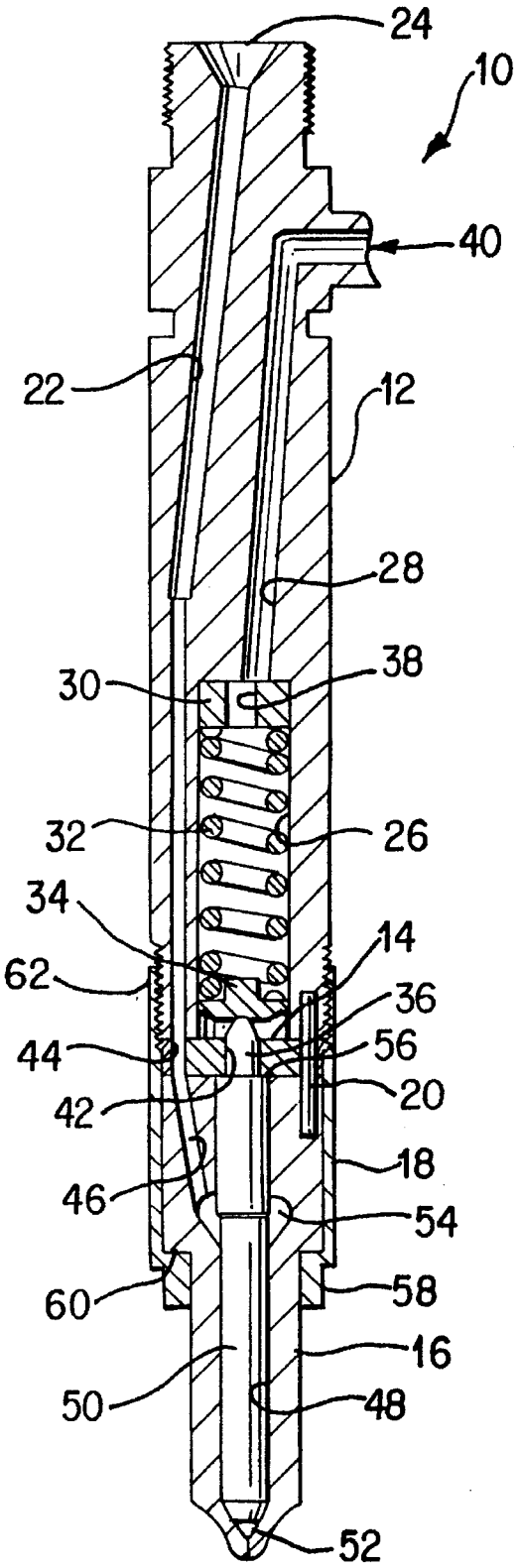
FIG. 1 PRIOR ART
FIG. 1 is a side sectional elevation view of a prior art jerk type fuel injector which is convertible into an accumulator type fuel injector and which is appropriately labeled "Prior Art"

Referring now to FIG. 1, a standard jerk type injector 10 which can be modified to produce an accumulator type injector includes an injector body 12, a spacer 14, and a nozzle body 16 which are axially aligned with one another and which are clamped together by a nut 18 threadedly connected to the injector body 12. Relative rotation of the injector body 12, spacer 14, and nozzle body 16 is prevented by a dowel pin 20.

The injector body 12 has formed therein a pressurized fluid supply passage 22, a needle spring chamber 26, and a vent passage 28. Passage 22 terminates at its upper end in an inlet opening into an orifice 24 normally connected to a cyclically activated pump (not shown). The spring chamber 26 is axially centered in the lower end portion of the injector body 12 and receives an upper spring seat 30 engaging a top wall of the chamber 26, a needle return spring 32, and a lower spring seat 34 which is slidably and non-sealingly disposed therein and which acts on a pin 36 affixed to a nozzle needle 50. A passage 38 is formed through the upper spring seat 30 so as to permit fluid to flow from the spring chamber 26 to the vent passage 28. The vent passage 28 terminates at its upper end in a vent orifice 40 which is typically connected to an unpressurized tank or reservoir (not shown).

The spacer 14 is relatively thin and has a central bore 42 formed therethrough which slidably and non-sealingly receives the pin 36. The spacer 14 also has a passage 44 formed therethrough connecting an outlet the pressurized fluid supply passage 22 in the injector body 12 to the inlet of a corresponding passage 46 in the nozzle body 16 so as to permit unrestricted two-way fluid flow therebetween.

The nozzle body 16 has formed therein the pressurized fluid supply passage 46 and a central axial bore 48. The bore 48 receives a nozzle needle 50, terminates in a nozzle cavity 52 at its lower end, and is enlarged at a central portion to form a kidney cavity 54 connected to the lower end of the pressurized fluid supply passage or nozzle body passage 46. The nozzle needle 50 is stepped so as to be sealed against a needle guide formed by the upper end of the bore 48 but so as to permit unrestricted two-way fluid flow between the kidney cavity 54 and the nozzle cavity 52 through an annulus formed along the edges of the bore 48. An upper cavity 56 surrounds the upper end of the nozzle needle 50 and is essentially sealed from the nozzle cavity 52 by the needle 50 but is in free fluid communication with the spring chamber 26 via the bore 42 in the spacer 14, thus permitting any small amounts of fuel that leak into cavity 56 from the nozzle cavity 52 to flow into the spring chamber 26.

The nut 18 comprises a generally tubular metal member stepped at its lower end portion 58 so as to engage a downwardly facing annular shoulder 60 on the nozzle body 16. An upper end portion 62 of the nut 18 is internally threaded so as to matably engage external threads on the injector body 12, thereby clamping the nozzle body 16 and the spacer 14 to the injector body 12 upon assembly.

In operation, the nozzle needle 50 is normally biased into engagement with its seat by the needle return spring 32 and pin 36, thus preventing injection. Injection is initiated by supplying pressurized fluid from a cyclically activated pump (not shown), through orifice 24, through the passages 22, 44, and 46, and into the kidney cavity 54 and nozzle cavity 52, where lifting forces imposed by pressurized fluid in the nozzle cavity 52 overcome the return forces imposed by the needle return spring 32, thereby lifting the needle 50 and permitting the ejection of fuel from nozzle cavity 52. Injection continues in this manner until supply pressure decreases beneath the level at which the lifting forces imposed thereby are overcome by the forces of the needle return spring 32, thus reseating the needle 50. Any small amounts of fuel which leak past the upper portion of the needle 50 into the cavities 56 and 26 during this time are vented from the injector 10 and into the reservoir via the vent passage 28 and vent orifice 40.

3. Conversion of Jerk Type Injector to Accumulator Type Injector

Figure 2:
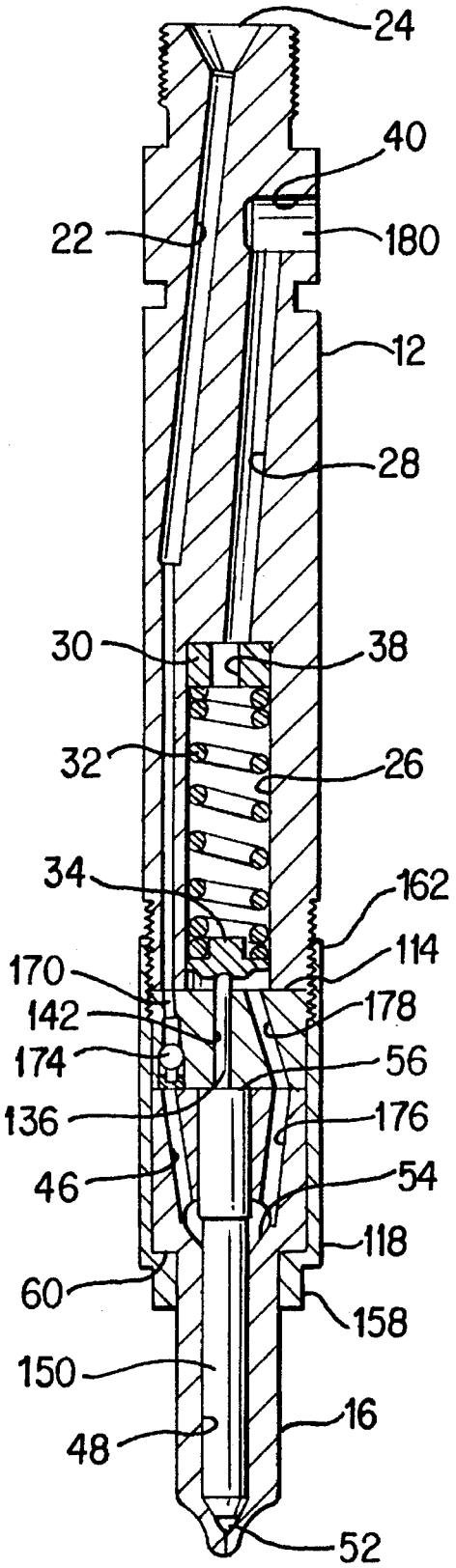
FIG. 2 is a side sectional elevation view of an accumulator type fuel injector formed by conversion of the jerk type injector of FIG. 1.
Figure 3:
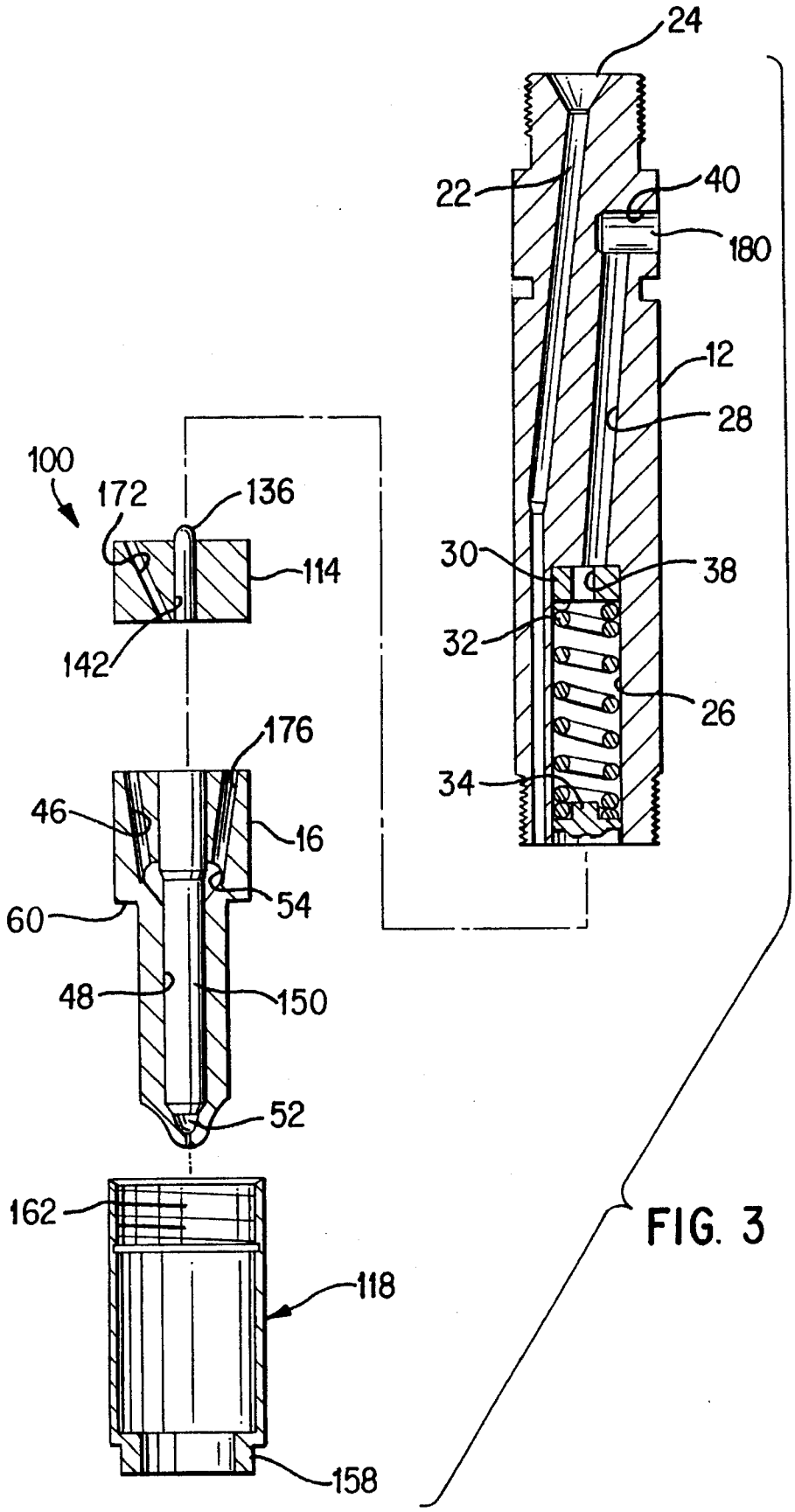
FIG. 3 is an exploded sectional elevation view of the fuel injector of FIG. 2 with the spacer being shown through a first vertical axis.
Figure 4:
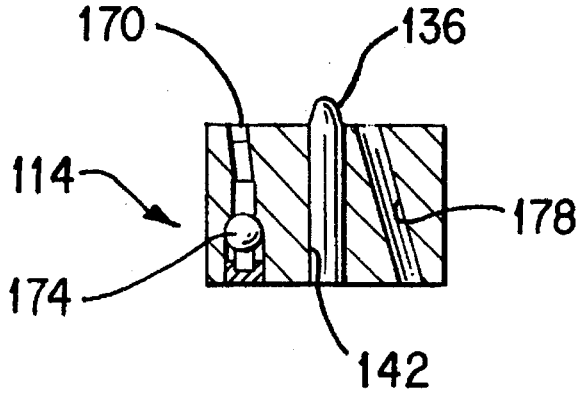
FIG. 4 is a sectional elevation view of the spacer of FIGS. 2 and 3 viewed through a second vertical axes.

The jerk type injector 10 of FIG. 1 can be convened to an accumulator type injector 100 of FIGS. 2–4 simply by replacing the spacer 14 with a second spacer 114 having at least first and second passages 170 and 172 formed therethrough. The first passage 170 interconnects the outlet of the pressurized fluid supply passage 22 and the inlet of pressurized fluid supply 46 and has a non-return element 174 disposed therein 1) which in the illustrated embodiment comprises a spring biased ball type check valve, 2) which permits substantially unrestricted fluid flow from the injector body passage 22 to the nozzle body passage 46, but 3) which at least substantially prevents return fluid flow therethrough. The second passage 172 (FIG. 3) extends through the spacer 114 and communicates with the first passage 170 either directly as illustrated or by a semi-arcuate chamber to permit two-way fluid communication between the pressurized fluid passage 22 and the upper cavity 56 in the nozzle body 16. As will become apparent from the description that follows, the addition of passage 172 is one of the most important steps in the conversion process because it is this passage and the associated cavity which in use create a control cavity permitting the injector to function as an accumulator-type injector.

Fluid flow from the upper cavity 56 to the spring chamber 26 is prevented by a seal pin 136 which slidably and sealingly engages a central axial bore 142 formed through the spacer 114. The seal pin 136, like the stock pin 36, extends into the cavity 56 and seats on the needle 50 at its lower end and extends into the cavity 26 and engages the spring seat 34 at its upper end. The upper cavity 56, being sealed from the spring chamber 26 but connected to the pressurized fluid supply passage 22 via passage 172, thus acts as a control cavity as will be detailed below.

It is conceivable that the passage 46, kidney cavity 54, and nozzle cavity 52 will provide sufficient volume beneath the check valve 174 to act as an accumulator. Additional volume in most instances, however, will be required to trap an adequate mass of fuel beneath the check valve 174 for injection. To this end, another passage 176 is drilled or preformed in the nozzle body 16, terminates in the kidney cavity 54, and cooperates with a third passage 178 extending through the spacer 114 and terminating at its upper end in the spring chamber 26. This modification, combined with the addition of a plug 180 in the bleed vent 40, permits the spring chamber 26 and the vent passage 28 to be added to the accumulator volume, thus providing more than ample volume downstream of the non-return element 174 to permit the injector 100 to function adequately as an accumulator type fuel injector under all operating conditions.

It can thus be seen that a jerk type injector 10 can be changed to an accumulator type injector 100 simply by removing the nut 18, drilling or preforming the passage 176 in the nozzle body 16 (if necessary), plugging the vent orifice 40 (if necessary), replacing the spacer 14 with a spacer 114, and by reassembling the injector 100 using a dowel pin (not shown) and a threaded nut. It should also be noted that this conversion process, though described in conjunction with a retrofit operation, could be performed as new construction without any prior disassembly.

Figure 5:
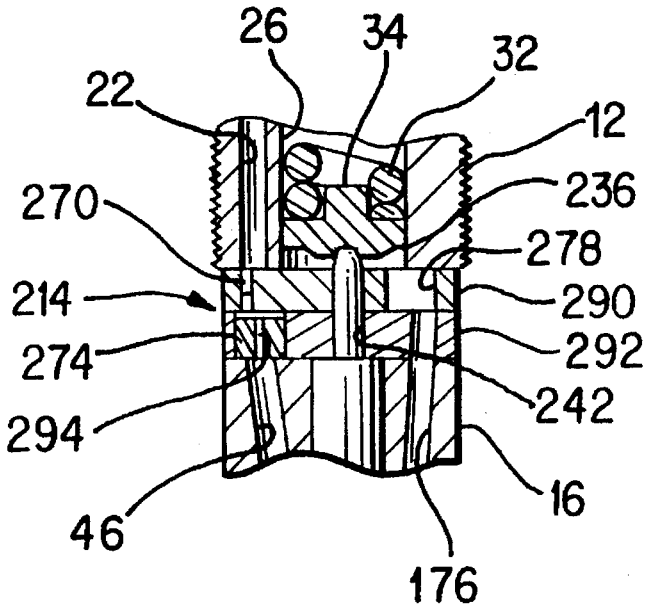
FIG. 5 is a sectional side elevation view of a portion of another accumulator type fuel injector which can be constructed through conversion of the fuel injector of FIG. 1.

Because the axial length of the spacer 114 must be somewhat longer than that of the spacer 14 to accommodate the necessary passages and check valve 174, reassembly of a converted injector or initial assembly of a new injector may require a nut 118 which is somewhat longer than stock nut 18. This additional modification may be avoided by employing a flat disk type check valve as the non-return element rather than a more conventional spring biased ball type check valve, thus permitting the use of a spacer which is somewhat thinner than that of the first embodiment and reducing the overall length of the injector to permit the use of a stock nut 18. Thus, referring to FIG. 5, a spacer 214 is illustrated which has the first through third passages formed therein as discussed above (with only the first and third passages 270 and 278 being shown) but which is formed from two sections 290 and 292. A sealing pin 236 extends through a central bore 242 and forms the same function as the sealing pin 136 of the first embodiment. The first passage 270 in the spacer 214 has a first, relatively narrow portion formed in the first section 290 of the spacer 214 and a second, relatively wide portion formed in the lower portion 292. A disk 274 is located in the lower portion of passage 270 and has a central bore 294 formed therethrough which is offset from the first portion of the passage 270 such that, when the disk 274 moves upwardly upon a pressure differential thereacross, the upper end of the bore 294 seals against the lower face of the first spacer section 290, thereby effectively preventing reverse fluid flow through the spacer assembly 214. When, on the other hand, fluid pressure above the disk 274 is higher than that below, the disk 274 moves downwardly to the position illustrated in FIG. 5 in which fluid can flow freely from the injector body supply passage 22 to the nozzle supply passage 46. Flat disk type check valves of this type are, per se, known and are described, e.g., in U.S. Pat. No. 5,287,838 to Wells.

The non-return element could also take the form of a flow restrictor, thus further simplifying construction. Check valves, however, are currently preferred because they do not restrict fuel flow towards the nozzle cavity and at the same time effectively prevent reverse flow.

4. Construction and Operation of Fuel Injection System Employing Converted Accumulator Type Fuel injector Referring now to FIG. 6, a fuel injection system 300 is illustrated in which the converted accumulator type fuel injectors 100 of FIGS. 2–5 are usable. The system includes a common fuel supply rail 302 and a plurality of injectors 100 (only one of which is illustrated) and, in the illustrated embodiment, additionally includes an intensifier assembly 304 for each injector 100. The common fuel supply rail 302 includes, as is conventional in the art, a pump 306 and a pressure regulator 308. Fuel supply rail 302 receives fuel from a fuel supply system 310 including a reservoir 312, a transfer pump 314, a filter 316, and a pressure regulator 318.

The intensifier assembly 304 includes an intensifier 320, a supply duct 322, and an electronic control valve in the form of a three-way, two position valve 324. Valve 324 has first and second ports connected to the fuel supply rail and vent via conduits 326 and 328, respectively, and a third port connected to a low pressure chamber 330 of the pressure intensifier 320 via a conduit 332 (it should be noted that the supply conduit 326 could be connected to a separate source of pressurized fluid such as a lube oil rail rather than to the common fuel rail 302 as illustrated). The intensifier 320 further includes a high pressure chamber 334 which is separated from the low pressure chamber 330 by a low pressure piston 336 and a high pressure plunger 338, which is connected to the common rail 302 by supply duct 322, and which is connected to the inlet/outlet port 24 the injector 100 by a conduit 340.

In use, fuel at rail pressure is normally supplied to the high pressure chamber 334 of the intensifier 320 through the supply duct 322 and also flows into the injector 100 through the inlet/outlet port 24. The injector 100 is charged or readied for injection by switching the control valve 324 from the illustrated position in which the low pressure chamber 332 of the intensifier 320 is connected to vent conduit 328 to a position in which it is connected to pressurized conduit 326. Pressurized fluid flows into low pressure chamber 332 and drives the piston 336 and plunger 338 downwardly, thus intensifying the pressure of fuel in high pressure chamber 334 by a multiple equal to the ratio of the areas of the piston 336 to the plunger 338, typically about 7 to 1 (reverse fluid flow through the supply duct 322 being prevented by a check valve 340). The thus-intensified fuel flows through the passage 340 and the inlet/outlet orifice 24, through the passages 22, 172, and 46, and into the accumulator (formed by spring chamber 26, nozzle cavity 52, kidney cavity 54, and the associated passages). Pressurized fuel from the high pressure chamber 334 also flows into the control cavity 56 from passage 172 at this time, thus opposing lifting forces imposed on the needle 150 by pressurized fuel in the accumulator and preventing injection.

Figure 6:
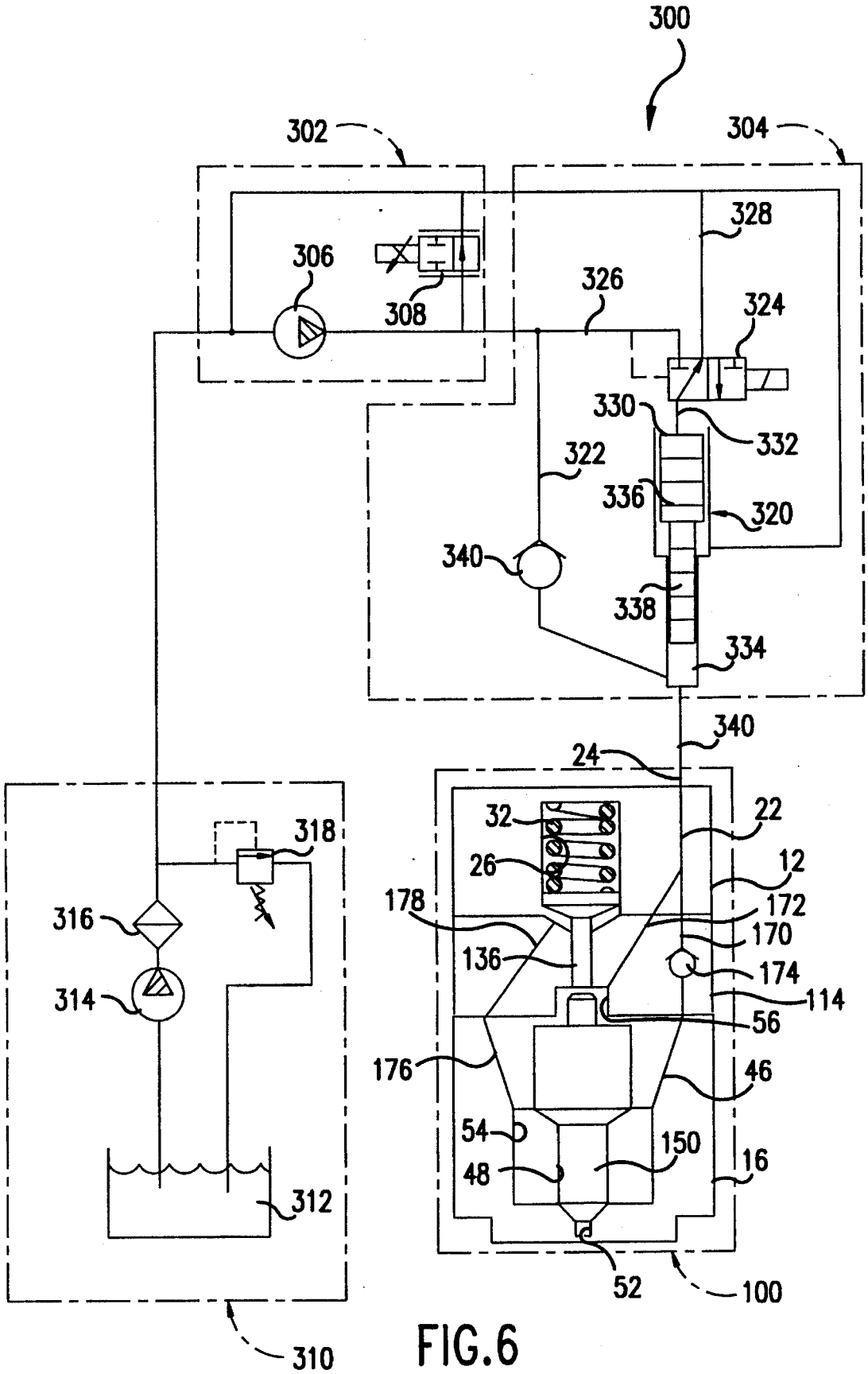
FIG. 6 schematically represents an accumulator type fuel injection system using either of the accumulator type injector of FIGS. 2–5.

Injection is initiated by returning the control valve 324 to the position illustrated in FIG. 6, thereby venting the intensifier low pressure chamber 330 and permitting the piston 336 and plunger 338 to move upwardly under fluid pressure within the high pressure chamber 334 and depressurizing high pressure chamber 334. Pressure also decays in the control cavity 56 at this time due to fluid flow into chamber 334 from passage 172, but return fluid flow from the accumulator is prevented by the check valve 174 or 274. Fuel injection commences when the return forces imposed by the needle return spring 32 and the decaying fluid pressure in the control cavity 56 are overcome by the lifting forces imposed by accumulator pressure in the nozzle cavity 52, and is maintained until sufficient fuel is ejected from the nozzle cavity 52 to reduce the pressure therein beneath a level at which the lifting forces imposed thereby are overcome by the return forces imposed by the needle return spring 32 and by the reduced fluid pressure in the control cavity 56. The injector 100 is now ready for the next charging event.

It can thus be seen that the converted injector 100 functions in all respects as an accumulator type injector and yet does not require the replacement of existing injectors to retrofit an engine with an accumulator type system, thus rendering conversion cost effective in many applications in which it heretofore would not have been. In addition, manufacturers of standard jerk type injectors would be more apt to convert at least a portion of their production operations to accumulator type fuel injector manufacture because only minor retooling and assembly changes would be required. The invention also promotes standardization and renders low volume production more cost effective.

It should be noted that many changes and modifications could be made to the invention as disclosed and described without departing from the spirit thereof. While some such changes were discussed above, the scope of other possible changes will become apparent from the appended claims.

We claim:

1. A method of assembling an accumulator type injector, said method including:

(A) providing (1) an injector body which has a pressurized fuel orifice formed in an outer surface thereof and which has a passage formed therethrough for the flow of pressurized fuel, said passage having an inlet in constant, substantially unrestricted fluid communication with said pressurized fuel orifice and having an outlet in constant, substantially unrestricted fluid communication with said inlet; and (2) a nozzle body having (1) a central axial bore formed therein which forms a lower nozzle cavity, and (2) a passage formed therethrough which has an outlet in fluid communication with said nozzle cavity and which has an inlet, and (3) a nozzle needle slidably and sealingly disposed in said axial bore and including a lower needle valve and an upper axial surface above which is disposed an upper cavity, said upper cavity being sealed from said nozzle cavity and in direct communication with said upper surface of said nozzle needle; then (B) inserting a spacer between said nozzle body and said injector body, said spacer having (1) a first passage connecting said inlet of said nozzle body passage to said outlet of said injector body passage, (2) a second passage connecting said injector body passage to said upper cavity and permitting two-way fluid flow therethrough, and (3) a non-return element which is disposed in said first passage and which at least substantially prevents return fluid flow therethrough; and then (C) fixing said injector body, said nozzle body, and said spacer in position.

2. A method as defined in claim 1, wherein (1) said spacer comprises a first spacer, and wherein (2) said providing step comprises providing a non-accumulator type fuel injector which includes (a) said injector body, (b) said nozzle body, (c) said nozzle needle, and (d) a second spacer disposed between said injector body and said nozzle body, said second spacer having a passage formed therethrough which connects said outlet of said injector body passage to said inlet of said nozzle body passage and which permits two-way fluid flow therethrough; and further comprising (A) disassembling said non-accumulator type injector prior to the step of inserting said first spacer between said nozzle body and said injector body, said disassembling step including removing said second spacer.

3. A method as defined in claim 1, wherein (1) said providing step further comprises providing an injector body having a spring chamber formed therein in which is disposed a needle return spring, and wherein (2) said inserting step comprises (a) inserting a spacer having (i) an axial bore formed therethrough in alignment with said spring chamber, and (ii) a third passage terminating in an upper orifice opening into said spring chamber, and further comprising (A) inserting a pin in said axial bore in said spacer so as (1) to be sealingly and slidably disposed in said bore, (2) to extend through said bore and into said spring chamber, and (3) to cooperate with said nozzle needle and said return spring so as to transfer biasing forces at least indirectly from said return spring to said nozzle needle; and (B) forming a second passage in said nozzle body permitting fluid communication between said second nozzle body passage and said third passage in said spacer.

4. A method as defined in claim 1, wherein (1) said spacer comprises a first spacer having a central axial bore and a third passage formed therethrough, said third passage terminating in an upper orifice opening into said spring chamber, and wherein (2) said providing step comprises providing a non-accumulator type injector which includes (a) said injector body, (b) said nozzle body, (c) said nozzle needle, (d) a second spacer disposed between said injector body and said nozzle body, said second spacer having (i) a passage formed therein which connects said injector body passage and said nozzle body passage and which permits substantially unrestricted two-way fluid flow therethrough, and (ii) an axial bore formed therethrough in alignment with said spring chamber, (e) a spring chamber which is formed in said injector body and in which is disposed a needle return spring, (f) a vent passage which is formed in said injector body and which connects said spring chamber to a vent, and (g) a pin which slidably and non-sealingly extends through said bore in said second spacer and which has a lower surface engaging said nozzle needle and an upper surface extending into said spring chamber; and further comprising (A) disassembling said non-accumulator type injector prior to said inserting step, said disassembling step including removing said second spacer and said pin;

(B) forming a second passage in said nozzle body permitting fluid communication between said nozzle body passage and said third passage in said first spacer;

(C) inserting another pin in said bore of said first spacer so as (1) to be sealingly and slidably disposed in said bore, (2) to extend through said bore and into said spring chamber, and (3) to engage said nozzle needle and to transfer biasing forces indirectly from said return spring to said nozzle needle; and (D) plugging said vent passage.

5. A method as defined in claim 1, wherein said providing step comprises providing a non-accumulator type injector which includes said injector body, said nozzle body, said nozzle needle, and a nut encasing said nozzle body and threadedly connected to said injector body, and further comprising removing said nut prior to said inserting step.

6. A method as defined in claim 5, wherein said non-return element comprises a ball-type check valve.

7. A method as defined in claim 6, wherein said nut is a first nut having a threaded axial end portion, and wherein the step of fixing said injector body, said nozzle body, and said spacer in position comprises encasing said nozzle body and said spacer in a second nut and attaching said second nut to said injector body, said second nut being longer than said first nut.

8. A method as defined in claim 5, wherein said non-return element comprises a flat disk-type check valve.

9. A method as defined in claim 8, wherein the step of fixing said injector body, said nozzle body, and said spacer in position comprises encasing said nozzle body and said spacer in said nut and attaching said nut to said injector body.

10. An accumulator type injector formed by the method of claim 1.

11. A method of converting a non-accumulator type injector to an accumulator type injector, said method including:

(A) providing a non-accumulator type injector including (1) an injector body which has (a) a passage formed therethrough for the passage of pressurized fuel, (b) a spring chamber formed therein and in which is disposed a needle return spring, and (c) a vent passage opening into said spring chamber, (2) a nozzle body having formed therein (a) a central axial bore, said axial bore forming a lower nozzle cavity and an upper cavity, and (b) a passage in fluid communication with said nozzle cavity, (3) a nozzle needle disposed in said axial bore and including a lower needle valve and an upper axial surface above which is disposed said upper cavity, said nozzle needle being sealingly mounted in said axial bore so as to seal said nozzle cavity from said upper cavity, (4) a first spacer which is disposed between said injector body and said nozzle body and which has formed therethrough (a) an axial bore in alignment with said spring chamber and (b) a passage connecting said injector body passage to said nozzle body passage and permitting substantially unrestricted two-way fluid flow therethrough, and (5) a pin which slidably and non-sealingly extends through said bore in said first spacer and which has a lower surface which engages said nozzle needle and an upper surface which is disposed in said spring chamber and which engages said spring; then (B) partially disassembling said injector including removing said first spacer;

(C) drilling another passage in said nozzle body in fluid communication with said nozzle body passage; then (D) inserting a second spacer between said nozzle body and said injector body, said second spacer having (1) a first passage formed therein and connecting said nozzle body passage to said injector body passage, (2) a second passage formed therein, connecting said injector body passage to said upper cavity, and permitting two-way fluid flow therethrough, (3) a non-return element which is disposed in said first passage and which permits substantially unrestricted fluid flow towards said nozzle body passage from said injector body passage but which at least substantially prevents return fluid flow therethrough, (4) a third passage which is formed therein, which connects said spring chamber and said another nozzle body passage, and which permits two-way fluid flow therethrough, and (5) an axial bore formed therethrough in alignment with said spring chamber;

(E) inserting another pin in said bore so as (1) to be slidably and sealingly disposed therein (2) to extend through said bore and into said spring chamber, and (3) to engage and said nozzle needle and said spring;

(F) fixing said injector body, said nozzle body, and said second spacer in position; and (G) plugging said vent passage.

12. An accumulator type injector formed by the method of claim 11.

13. An accumulator type fuel injector comprising:

(A) an injector body which has a pressurized fuel orifice formed in an outer surface thereof and which has a passage formed therethrough for the passage of pressurized fuel, said passage having an inlet in constant, substantially unrestricted fluid communication with said pressurized fuel orifice and having an outlet in constant, substantially unrestricted fluid communication with said inlet;

(B) a nozzle body having formed therein (a) a central axial bore forming a lower nozzle cavity and an upper cavity, and (b) a passage in fluid communication with said nozzle cavity;

(C) a nozzle needle disposed in said axial bore, said nozzle needle including a lower needle valve and an upper axial end above which is disposed said upper cavity, said nozzle needle sealing said nozzle cavity from said upper cavity;

(D) a spacer which is disposed between said injector body and said nozzle body, said spacer having (1) a first passage formed therein and connecting said nozzle body passage to said outlet of said injector body passage, (2) a second passage formed therein, connecting said injector body passage to said upper cavity, and permitting two-way fluid flow therethrough, and (3) a non-return element which is disposed in said first passage and which at least substantially prevents return fluid flow therethrough.

14. An accumulator type fuel injector comprising:

(A) an injector body which has a passage formed therethrough for the passage of pressurized fuel;

(B) a nozzle body having formed therein (a) a central axial bore forming a lower nozzle cavity and an upper cavity, and (b) a passage in fluid communication with said nozzle cavity;

(C) a nozzle needle disposed in said axial bore, said nozzle needle including a lower needle valve and an upper axial end above is disposed said upper cavity, said nozzle needle sealing said nozzle cavity from said upper cavity;

(D) a spacer which is disposed between said injector body and said nozzle body, said spacer having (1) a first passage formed therein and connecting said nozzle body passage to said injector body passage, (2) a second passage formed therein, connecting said injector body passage to said upper cavity, and permitting two-way fluid flow therethrough, and (3) a non-return element which is disposed in said first passage and which at least substantially prevents return fluid flow therethrough, wherein (4) a spring chamber is formed in said injector body, (5) another passage is formed in said nozzle body in two-way fluid communication with said nozzle body passage, (6) a third passage is formed in said spacer and connects said spring chamber to said another nozzle body passage, and (7) an axial bore is formed through said spacer in alignment with said spring chamber; and further comprising (E) a pin which slidably and sealingly extends through said axial bore in said spacer, which engages an axial end surface of said nozzle needle, and which extends into said spring chamber.

15. An injector as defined in claim 14, wherein said non-return element comprises a ball-type check valve.

16. An injector as defined in claim 14, wherein said non-return element comprises a flat disc-type check valve.

* * * * *